United States Patent [19]

Budzyn et al.

[11] Patent Number: 4,537,239

[45] Date of Patent: Aug. 27, 1985

[54] TWO PIECE CASTING WHEEL

[75] Inventors: Boleslaw L. Budzyn, Passaic; Charles E. Carlson, Succasunna, both of N.J.

[73] Assignee: Allied Corporation, Morris Township, Morris County, N.J.

[21] Appl. No.: 641,939

[22] Filed: Aug. 20, 1984

Related U.S. Application Data

[63] Continuation of Ser. No. 397,755, Jul. 13, 1982, abandoned.

[51] Int. Cl.[3] ..... B22D 11/06

[52] U.S. Cl. ..... 164/423; 164/429; 164/443

[58] Field of Search ..... 164/423, 443, 463, 427, 164/429

[56] References Cited

U.S. PATENT DOCUMENTS

| | | | |
|---|---|---|---|
| 1,392,626 | 10/1921 | Cox | 165/89 |
| 1,781,378 | 4/1928 | Feeney | 165/89 |
| 3,135,319 | 12/1959 | Richards | 165/89 |
| 3,845,810 | 11/1974 | Gerding | 164/276 |
| 4,050,510 | 9/1977 | Theysohn | 165/89 |
| 4,090,553 | 5/1978 | Beghin | 164/448 |
| 4,142,571 | 3/1979 | Narasimhan | 164/88 |
| 4,197,900 | 4/1980 | Bloshenko et al. | 164/348 |
| 4,307,771 | 12/1981 | Draizen et al. | 164/463 |
| 4,442,883 | 4/1984 | Yamakami | 164/448 |

FOREIGN PATENT DOCUMENTS

| | | | |
|---|---|---|---|
| 809546 | 7/1951 | Fed. Rep. of Germany . | |
| 2707907 | 8/1977 | Fed. Rep. of Germany . | |
| 184398 | 3/1967 | U.S.S.R. | 164/428 |

*Primary Examiner*—Nicholas P. Godici
*Assistant Examiner*—Richard K. Seidel
*Attorney, Agent, or Firm*—Paul Y. Yee; Gerhard H. Fuchs

[57] ABSTRACT

The invention provides a chilled casting wheel. An annular wheel core member has axially extending channels formed about a circumferential, outer peripheral surface thereof and is adapted to rotate about a concentric axis of rotation. A cylindrical, axially extending wheel rim member concentrically connected to the core peripheral surface has a preselected interference fit therewith to provide a preselected residual, circumferential stress within the rim. A coolant mechanism directs a fluid coolant to the interior surface of the rim and through the channels.

20 Claims, 4 Drawing Figures

TWO PIECE CASTING WHEEL

This application is a continuation of application Ser. No. 397,755 filed July 13, 1982, now abandoned.

BACKGROUND OF THE INVENTION

1. Field of the Invention

The invention relates to a chill casting wheel for the continuous casting of filamentary material. More particularly, the invention relates to casting wheels used to cast glassy metal filaments.

2. Description of the Prior Art

In the production of glassy alloy continuous filaments, typically an appropriate molten alloy is quenched at extreme quench rates, usually at least about $10^4$° C. per second by extruding the molten alloy from a pressurized reservoir through an extrusion nozzle onto a high speed rotating quench surface as is representatively shown in U.S. Pat. No. 4,142,571 for "Continuous Casting Method for Metallic Strips" issued Mar. 6, 1978 to Narasimhan, hereby incorporated by reference. Such filaments are necessarily thin, typically about 25–100 microns, due to the extreme heat transfer rate required to prevent substantial crystallization, though considerable selectivity may be exercised respecting the trans-dimensions and cross-section of the filament.

U.S. Pat. No. 4,307,771 for "Force-Convection-Cooled Casting Wheel" issued Dec. 29, 1981 to S. Draizen, et al. shows a casting wheel having a thick stiffening section which supports the quench surface and contains peripheral, drilled coolant passages located in proximity to the quench surface. The wheel is constructed to resist crowning-type distortions where the casting wheel radius at the quench surface edges becomes less than the wheel radius at the quench surface circumferential center line. When casting wide filaments greater than about 5 cm in width, however, such stiffened casting wheels do not provide sufficient crowning resistance.

Contoured quench surfaces have been used to address the crowning problem on rollers. However, casting wheels with contoured quench surfaces have been unsatisfactory because each particular contoured surface is effective only when specific use conditions of temperature and filament width are met. A variation in filament width, extrusion temperature or filament quench rate prevents the contoured surface from properly compensating for crowning-type distortions. Other problems with contoured quench surfaces include the cost and difficulty of initially machining the complex contours on the casting wheel quench surface and of periodically refurbishing the quench surface to maintain the precise contour.

Thus, ordinary casting wheels remain susceptible to crowning-type distortion problems, especially when wider filaments are cast. The wheels are difficult to refurbish and are unable to satisfactorily cast filaments having varied widths or requiring varied quench rates.

SUMMARY OF THE INVENTION

The invention provides a chilled casting wheel that resists crowning, affords uniform quenching of wide ribbon and is economical to manufacture and refurbish. Generally stated, the casting wheel includes an annular wheel core member which has axially extending challels formed about a circumferential, outer peripheral surface thereof and is adapted to rotate about a concentric axis of rotation. A cylindrical, axialy extending wheel rim member is concentrically connected to the core peripheral surface and has a preselected interference fit therewith to provide a preselected residual, circumferential tensile stress within the rim. A coolant means directs a fluid coolant to the interior surface of the rim and through the channels of the wheel core.

In a preferred embodiment, the casting wheel of the invention includes a hub shaft member which has a concentric axis of rotation and two axial end portions. Each end portion delimits an axial coolant chamber having at least one, but preferably a plurality of coolant supply passages communicating radially therefrom. An annular wheel core member is concentrically connected to the hub shaft and adapted to rotate therewith. The wheel core has axially extending coolant channels formed about an outer peripheral surface thereof and two axially facing side portions. A cylindrical, axially extending wheel rim member is concentrically connected to the peripheral core surface and has a preselected interference fit therewith to provide a residual, circumferential tensile stress within the rim. Two annular flange members are connected concentric with the hub shaft and adjacent to each of the core side portions to delimit an annular coolant chamber at each side of the wheel core which communicates with its respective coolant supply passages.

The casting wheel of the invention is over eight times more resistant to crowning than ordinary casting wheels, and is able to cast filament of greater width having more uniform dimensions and physical properties. The casting wheel provides improved heat transfer and more uniform quenching across the width of the wheel, and since the more rigid casting wheel construction has less tendency to become eccentric when rotating and subjected to thermal loads, the wheel is able to cast any width ribbon, less than the width of the wheel, at random locations across the quench surface without crowning problems. In addition, the wheel is easier to refurbish because the casting wheel rim can be easily replaced whenever it becomes worn or damaged. Since the wheel core and other parts are reusable, costs are greatly reduced. With the two piece construction, different, individually suited materials can be used for the wheel core and the wheel rim as required. Thus, the invention provides a less expensive and more versatile casting wheel that is more resistant to crowning, provides improved quenching, is easier to maintain and refurbish and is capable of casting wider filaments than ordinary casting wheels having thickened support sections or contoured quench surfaces.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

For the purposes of this invention and as used in the specification and claims, the term "filament" is a slender body whose transverse dimensions are much smaller than its length. Thus, the term filament includes wire, ribbon, sheet and the like of regular or irregular cross-section.

Figure 1:
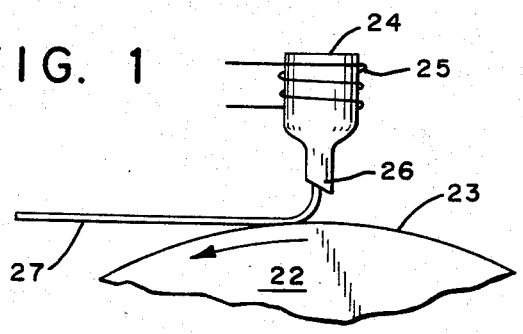
FIG. 1 is a simplified perspective view of an apparatus for continuous casting of metallic strip.

Referring to FIG. 1 of the drawings, a representative apparatus for the continuous casting of a glassy alloy filament is illustrated to point out the general use of the present invention. An extrusion means is comprised of a reservoir crucible 24 and an extrusion nozzle 26. Molten alloy contained in crucible 24 is heated by a heating element 25, and pressurization of the crucible with an inert gas extrudes a molten stream through nozzle 26 located at the base of the crucible onto quench surface 23 of casting wheel 22.

The apparatus of this invention is suitable for forming polycrystalline strip of aluminum, tin, copper, iron, steel, stainless steel and the like. However, metal alloys that upon rapid cooling from the melt form solid amorphous, glassy structures are preferred. Such alloys are well known to those skilled in the art, and examples are disclosed in U.S. Pat. Nos. 3,427,154; 3,981,722 and others.

Figure 2:
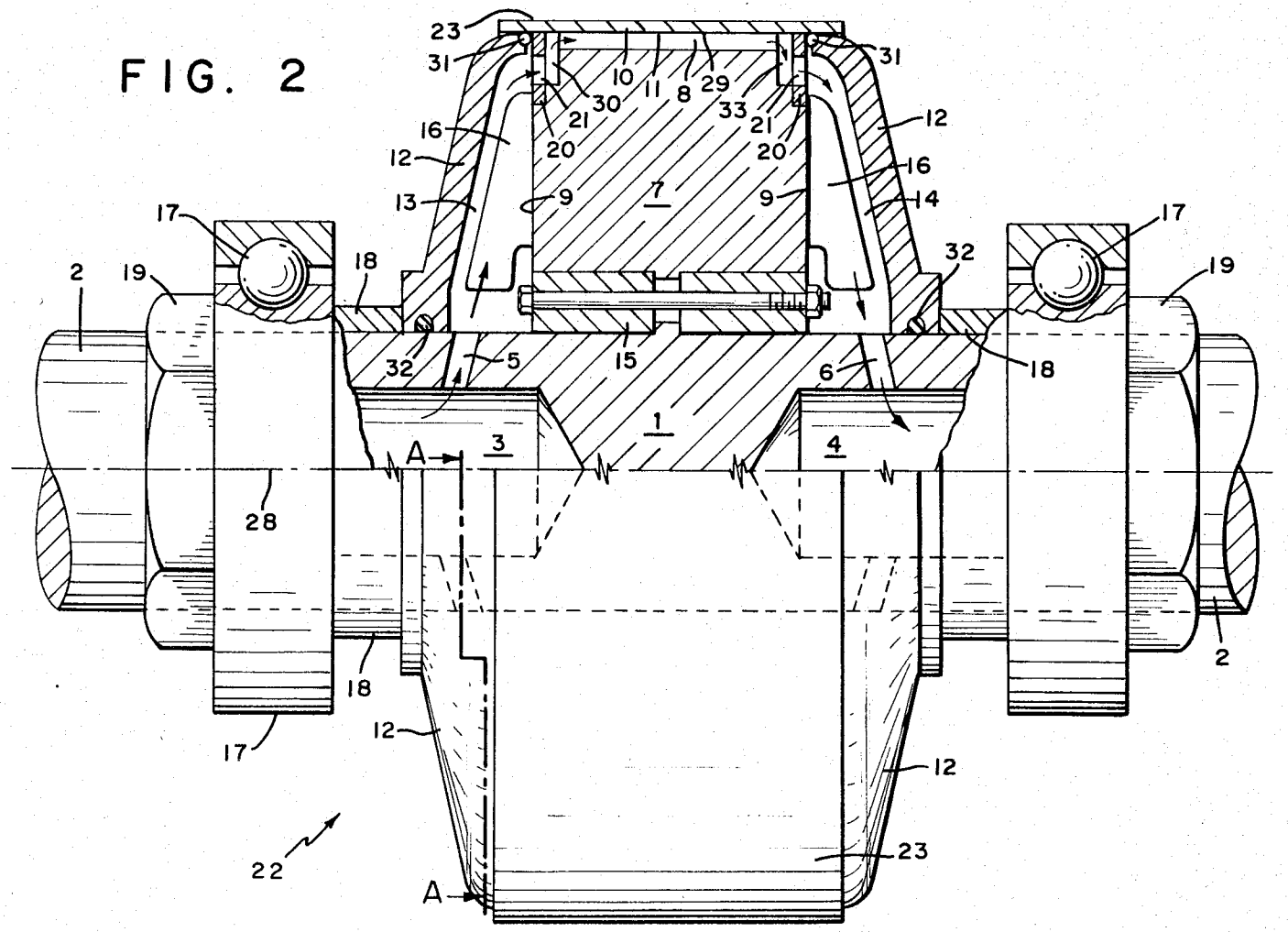
FIG. 2 is a partial cross-sectional view of the casting wheel of the invention.

FIG. 2 shows the casting wheel of the invention generally at 22. An annular wheel core member 7 has axially extending channels 8 formed about a circumferential, outer peripheral surface 11 thereof and is adapted to rotate about a concentric axis of rotation 28. A cylindrical, axially extending wheel rim member 10 is concentrically connected to the core peripheral surface 11 and has a preselected interference fit therewith to provide a preselected, residual, circumferential tensile stress within the rim. A coolant means directs a fluid coolant to the interior surface 29 of rim 10 through channels 8.

Figure 3:
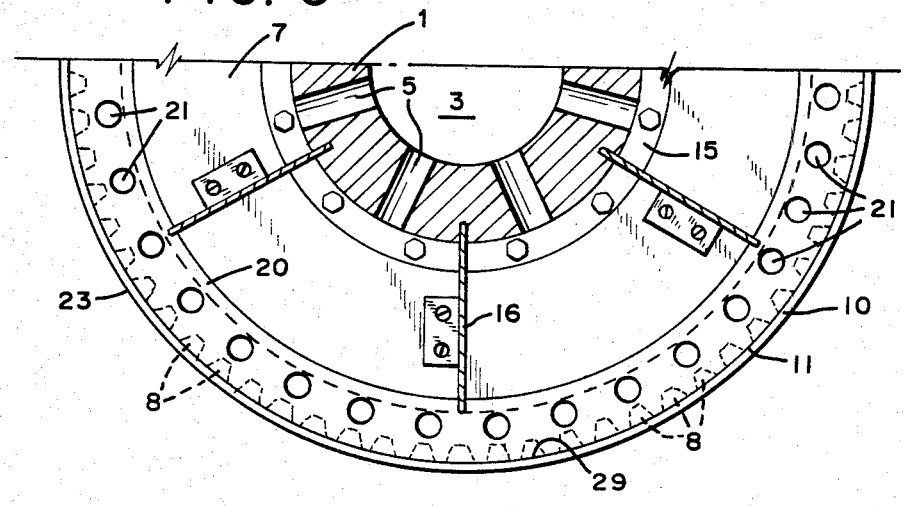
FIG. 3 is a fractional cross-sectional view taken along line A—A of FIG. 1.

FIGS. 2 and 3 show a preferred embodiment of the casting wheel of the invention wherein the coolant means is comprised generally of hub shaft member 1 and two flange members 12. In this embodiment, hub shaft member 1 has a concentric axis of rotation 28 and two axial end portions 2. The end portions delimit axial coolant chambers 3 and 4, and at least one, but preferably a plurality of coolant supply passages 5 and 6 communicate radially from chambers 3 and 4, respectively. An annular wheel core member 7, concentrically connected to hub shaft 1, is adapted to rotate therewith and provides two axially facing side portions 9. A plurality of axially extending channels 8 are formed about the outer peripheral surface 11 of the core, and a cylindrical, axially extending wheel rim 10 is mounted thereon. Rim 10 has a preselected interference fit with core 7 to provide a preselected residual, circumferential tensile stress within rim 10. Two annular flange members 12 are connected concentric with hub shaft 1 and adjacent to each of the core side portions 9 to delimit annular coolant chambers 13 and 14 at each side of wheel core 7 which communicate with their respective coolant supply passages 5 and 6.

Hub shaft 1 is constructed of a suitable material, such as metal, and provides two opposite end portions 2. An inlet chamber 3 is cast or machined into one end portion and a plurality of outlet passages 5 are formed radially through hub shaft 1 to communicate and conduct coolant from chamber 2. Similarly, an outlet chamber 4 is cast or machined into the opposite end portion, and a plurality of passages 6 communicate radially from chamber 4.

Annular wheel core member 7 is constructed of a suitable material, such as stainless steel, but preferably is constructed of a material having a low coefficient of thermal expansion, such as INVAR (registered trademark), an iron-nickel alloy consisting essentially of about 64% iron and about 36% nickel. Core 7 provides two axially facing side portions 9, and is concentrically connected to hub shaft 1 by means of a conventional annular locking assembly 15 to rotate with hub shaft 1. By constructing core 7 from INVAR alloy and employing locking assembly 15, the casting wheel has improved dimensional stability, less runout and a reduced tendency to expand or become eccentric during the filament quenching operation. Axially extending channels 8 are formed about outer peripheral surface 11 by a suitable method, such as machining. The machined channels are easier and less expensive to produce than the drilled passages employed by conventional casting wheels. Channels 8 allow a coolant flow across the width (measured axially) of core 7 which contacts the interior surface 29 of rim 10 and thereby cools quench surface 23. In the shown embodiment, channels 8 are spaced approximately 0.25 in (0.64 cm) apart and configured to provide a desired volume of coolant flow.

Cylindrical, axially extending wheel rim 10 is concentrically connected to peripheral core surface 11 with a preselected interference fit to provide a residual, circumferential tensile stress within rim 10. A preferred material for rim 10 is beryllium-copper alloy because of its higher thermal conductivity. To obtain the desired interference fit, rim 10 is shrink fitted onto wheel core 7. For example, when producing a 15 in diameter casting wheel, rim 10 is constructed with an inside radius approximately 30 mils (0.076 cm) smaller than the radius of peripheral surface 11. Rim 10 is then heated to a temperature of approximately 600° F. (316° C.) to expand the radial dimension of the rim and allow placement about surface 11 of core 7. Upon cooling, rim 10 contracts to form an interference fit onto surface 11 which produces an internal residual tensile stress within the rim of approximately 75,000 psi. It is readily apparent that various amounts of interference fit are suitable, provided the resultant residual stress is less than the yield stress of the rim material but large enough to hold rim 10 in contact with core 7 against the thermal loads encountered during the casting operation.

Two annular radially extending support rings 20 connect to core 7 by means of an interference fit into a circumferential groove machined into each of the core side portions 9. Rings 20 support the edges of rim 10 and provide a sealing surface against which to connect the respective flange members 12. A plurality of openings 21 extend through ring 20 to allow coolant to flow to annular, radially extending channels 30 and 33 machined into the peripheral edges of their respective core side portions. Channels 30 and 33 are suitably sized and configured to conduct coolant between the respective rings 20 and channels 8.

Two annular, dished flange members 12 are connected concentric with hub shaft 1 and adjacent to each of the core side portions 9 to delimit an annular inlet coolant chamber 13 at one side of core 7 and an annular outlet coolant chamber 14 at the opposite side of core 7. Coolant chamber 13 communicates with axial chamber 3 through passages 5, and coolant chamber 14 communicates with axial chamber 4 through passages 6. The outer edge of each flange 12 mates against its respective edge of rim 10 and the corresponding support ring 20, and is provided with a fluid seal, such as an elastomeric O-ring seal 31. The inner edge of each flange 12 mates with hub shaft 1 and is provided with a fluid seal, such as an elastomeric O-ring seal 32. A plurality of coolant vanes 16, connected to core 7 and disposed within chambers 13 and 14, direct coolant radially through chambers 13 and 14.

Suitable bearings 17 are positioned about hub shaft 1 and are spaced from the sides of flange members 12 by suitable spacers 18. Assembly nuts 19 are then threaded onto hub shaft 1 and suitably torqued to provide compressive, axial loads of about 12,000 lb-force which hold flange members 12 in sealing engagement with hub shaft 1, rim 10 and support rings 20. The end portions of hub shaft 1 are suitably connected to a source of fluid coolant by means of conventional rotating unions.

During operation, a suitable fluid coolant, such as water, flows from a source into axial chamber 3, then through passages 5 and into inlet chamber 13. Vanes 16 direct coolant through openings 21 in support rings 20 and into channel 30, after which it flows through channels 8 contacting rim 10 to cool quench surface 23. The coolant then enters channel 33 and flows through openings 21 into outlet chamber 14. Vanes 16 direct the coolant to passages 6 through which it flows into axial chamber 4 and then away from the wheel. Wheel 22 is spun up to a desired rotational speed and molten metal is extruded from crucible 24 through nozzle 26 onto quench surface 23 to produce continuous filament 27.

Figure 4:
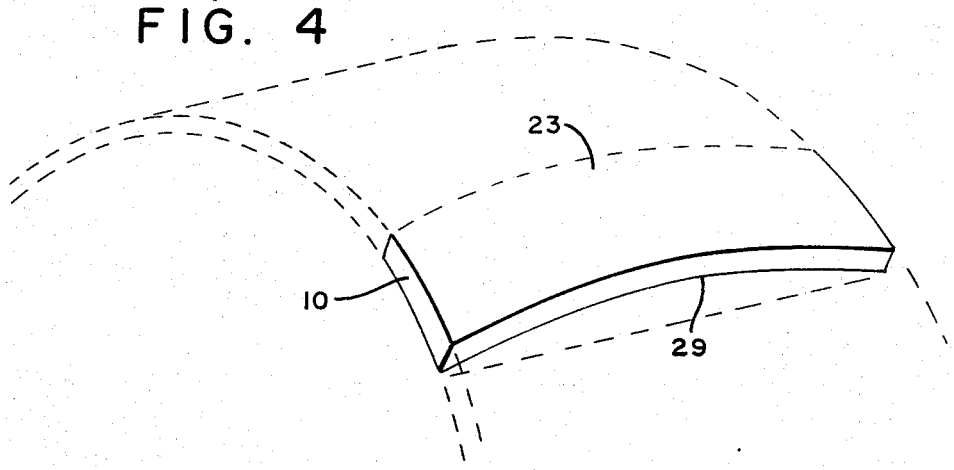
FIG. 4 is a schematic representation of casting wheel surface crowning.

The residual circumferential tensile stress in rim 10 provides substantially improved crowning resistance by counteracting the thermally induced stresses that tend to increase the rim radius at the circumferential center line of the rim relative to the rim radius at the edges of the rim. As representatively shown in FIG. 4, a thermal gradient, between a hot quench surface 23 and a cool interior surface 29, induces a thermal stress which tends to expand quench surface 23 relative to interior surface 29 and thereby tends to bend (crown) rim 10. The residual tensile stress in rim 10, however, counteracts this thermal stress to hold rim 10 substantially flat across the width of core 7, thus providing a dimensionally stable quench surface 23 having marked resistance to crowning.

The crowning resistance is further enhanced by constructing rim 10 as thin as practicable (measured radially) since less force is needed to restrain a thin member from crowning. A rim thickness ranging from about 0.06 inches (0.15 cm) to about $\frac{1}{4}$ inch (0.64 cm) is preferred. However, rim 10 should be thick enough to carry the residual rim stresses without deforming, and thick enough to damp the thermal energy wave propagating inward from the quench surface that would otherwise cause boiling of the coolant. In the shown embodiment, rim 10 is approximately 90 mils (0.23 cm) thick.

The thin rim also improves the radial heat transfer from quench surface 23 through the rim body to the coolant in channels 8, and thus provides a more uniform quench rate across the width (measured axially) of rim 10. As a result of the improved crowning resistance and more uniform quench rate, the casting wheel can be constructed to cast filaments greater than 5 cm in width. The resultant casting wheel is not sensitive to the width of the filament cast thereon, provided the width is less than the width of the wheel quench surface. Thus a wide filament, a narrow filament or even a simultaneous grouping of narrow filaments can be cast on the casting wheel quench surface at random locations without degrading the ability of the casting wheel to resist crowning. The casting wheel of the invention could be constructed as wide as a roller-type wheel, wherein the wheel width is greater than its diameter, and still retain its resistance to crowning. As a practical matter, however, the wheel width is limited by the allowable temperature rise of the coolant as it traverses the width through the coolant channels 8.

For example, a casting wheel having a stainless steel wheel core was constructed in accordance with the invention and used to cast a filament of glassy metal alloy approximately 4 inches (10.16 cm) wide. The physical profile of the quench surface across the axial, width of the wheel was measured before and during the casting operation. Upon comparing the profiles, the measured amount of crowning was approximately 0.5 mils (0.00127 cm). In contrast, when a 4 inch glassy metal ribbon was cast using a casting wheel of ordinary construction, the measured amount of crowning effect was approximately 4 mils (0.0102 cm). Thus, the casting wheel of the present invention was approximately eight times more resistant to crowning than the ordinary casting wheel.

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. A chilled casting wheel capable of providing a quench rate of at least about $10^{4}$° C./sec, comprising:

(a) an annular wheel core member having axially extending channels formed about a circumferential, outer peripheral surface thereof and being adapted to rotate about a concentric axis of rotation;

(b) a separate, cylindrical, axially extending wheel rim member concentrically connected to said core peripheral surface, said rim having a radial thickness ranging from about 0.060 in (0.15 cm) to about 0.25 in (0.64 cm) and having a preselected interference fit with said core to provide a preselected residual, circumferential tensile stress within said rim, wherein said residual stress counteracts crowning stresses induced by a radial temperature gradient between an outer quench surface and an interior surface of said rim to hold said rim substantially flat across the width of said wheel core member; and (c) coolant means for directing a fluid coolant to the interior surface of said rim and through said channels.

2. The casting wheel as recited in claim 1, wherein said wheel rim member has a thickness measured radially of 90 mils (0.23 cm).

3. The casting wheel as recited in claim 1, wherein said wheel rim is shrink fitted onto said wheel core to provide said interference fit.

4. A chilled casting wheel, capable of providing a quench rate of at least about $10^{4}$° C./sec, comprising:

(a) a hub shaft member having a concentric axis of rotation and two axial end portions, each end portion delimiting an axial coolant chamber having at least one coolant supply passage communicating radially therefrom;

(b) an annular wheel core member concentrically connected to said hub shaft and adapted to rotate therewith, said wheel core having axially extending channels formed about an outer peripheral surface thereof and two axially facing side portions;

(c) a separate, cylindrical, axially extending wheel rim member concentrically connected to said peripheral core surface, said rim having a radial thickness ranging from about 0.060 in (0.15 cm) to about 0.25 in (0.64 cm) and having a preselected interference fit with said core to provide a residual, circumferential tensile stress within said rim, wherein said residual stress counteracts crowning stresses induced by a radial temperature gradient between an outer quench surface and an interior surface of said rim to hold said rim substantially flat across the width of said wheel core member; and (d) two annular flange members connected concentric with said hub shaft and adjacent to each of said core side portions to delimit an annual coolant chamber at each side of said wheel core which communicates with its respective coolant supply passage.

5. The casting wheel as recited in claim 5, wherein said wheel rim member has a thickness measured radially of 90 mils (0.23 cm).

6. The casting wheel as recited in claim 4, wherein said wheel rim is shrink fitted onto said wheel core to provide said interference fit.

7. The casting wheel as recited in claim 4, wherein said wheel core member is comprised of a material having a low coefficient of thermal expansion.

8. The casting wheel as recited in claim 4, wherein said wheel core is comprised of a metal alloy, which has a low coefficient of thermal expansion and consists essentially of iron and nickel.

9. The casting wheel as recited in claim 4, wherein said wheel rim is comprised of a beryllium-copper alloy having a high thermal conductivity.

10. A chilled casting wheel for providing a quench rate of at least about $10^4$° C./sec, comprising:

(a) an annular wheel core member concentrically connected to a hub shaft and adapted to rotate therewith, said wheel core having axially extending channels formed about an outer peripheral surface thereof, two axially facing side portions, and an annular, radially extending channel in each of said side portions for conducting coolant to and from said axial channels;

(b) a separate, cylindrical, axially extending wheel rim member concentrically connected to said peripheral core surface having a preselected interference fit therewith to provide a residual, circumferential tensile stress within said rim, wherein said residual stress counteracts crowning stresses induced by a radial temperature gradient between an outer quench surface and an interior surface of said rim to hold said rim substantially flat across the width of said wheel core member;

(c) two annular flange members connected concentric with said hub shaft and adjacent to each of said core side portions to delimit an annular coolant chamber at each side of said wheel core which communicates with respective coolant supply passages; and (d) a ring member located at both axial edges of said rim member with each ring member spaced axially from said axially extending wheel core channels, said ring member connected to said core member for supporting the edges of said rim member and for providing a sealing surface against which to connect the respective flange members, and said ring member having a plurality of openings extending axially therethrough into said annular channels in the face portions of the wheel core.

11. A chilled casting wheel as recited in claim 10, further comprising a plurality of coolant vanes disposed within said annular coolant chambers to direct coolant radially therethrough.

12. A chilled casting wheel as recited in claim 11, wherein said coolant vanes are connected to said core member.

13. A chilled casting wheel as recited in claim 10, wherein said hub shaft member has a concentric axis of rotation and two axial end portions, each end portion delimiting an axial coolant chamber having at least one coolant supply passage communicating radially therefrom into said coolant chambers located at each side of said wheel core.

14. A casting wheel as recited in claim 10, wherein the thickness of said wheel rim member measured radially ranges from about 0.060 in (0.015 cm) to about 0.25 in (0.64 cm).

15. A casting wheel as recited in claim 10, wherein said wheel rim member has a thickness measured radially of 90 mils (0.23 cm).

16. A casting wheel as recited in claim 10, wherein said wheel rim is shrink fitted onto said wheel core to form said interference fit and produce a residual stress within the rim of about 75,000 psi.

17. A chilled casting wheel for providing a quench rate of at least about $10^4$° C./sec, comprising:

(a) a hub shaft member having a concentric axis of rotation and two axial end portions, each end portion delimiting an axial coolant chamber having at least one coolant supply passage communicating radially therefrom;

(b) an annular wheel core member concentrically connected to said hub shaft and adapted to rotate therewith, said wheel core having axially extending channels formed about an outer peripheral surface thereof, two axially facing side portions, and an annular, radially extending channel in each of said side portions for conducting coolant to and from said axial channels;

(c) a separate, cylindrical, axially extending wheel rim member, which is concentrically connected to said peripheral core surface, has a preselected interference fit therewith to provide a residual, circumferential tensile stress within said rim, and which has a thickness, measured radially, ranging from about 0.060–0.25 in (0.15–0.64 cm), wherein said residual stress counteracts crowning stresses induced by a radial temperature gradient between an outer quench surface and an interior surface of said rim to hold said rim substantially flat across the width of said wheel core member;

(d) two annular flange members connected concentric with said hub shaft and adjacent to each of said core side portions to delimit an annular coolant chamber at each side of said wheel core which communicates with its respective coolant supply passage;

(e) a ring member located at each axial edge of said rim member, each ring member being connected to said wheel core and spaced axially from said axially extending channels, providing a sealing surface against which to connect the respective flange member, and having a plurality of openings extending axially therethrough into said annular channels in the face portions of the wheel core; and (f) a plurality of coolant vanes disposed within said annular coolant chambers to direct coolant radially therethrough, said vanes aligned radially and positioned to face circumferentially.

18. The casting wheel as recited in claim 17, wherein said wheel rim member has a thickness measured radially of 90 mils (0.23 cm).

19. The casting wheel as recited in claim 17, wherein said wheel rim is shrink fitted onto said wheel core to provide said interference fit.

20. A casting wheel as recited in claim 17, wherein said wheel rim is shrink fitted onto said wheel core to provide said interference fit and produce a residual internal stress within the rim of about 75,000 psi.

* * * * *